US011565145B2

(12) United States Patent
Schrag

(10) Patent No.: US 11,565,145 B2
(45) Date of Patent: Jan. 31, 2023

(54) MOBILE TRAINING DEVICE

(71) Applicant: BLBW AG, Schwarzsee (CH)

(72) Inventor: Michael Schrag, Schwarzsee (CH)

(73) Assignee: BLBW AG, Schwarzsee (CH)

( * ) Notice: Subject to any disclaimer, the term of this patent is extended or adjusted under 35 U.S.C. 154(b) by 0 days.

(21) Appl. No.: 17/270,887

(22) PCT Filed: Aug. 28, 2019

(86) PCT No.: PCT/EP2019/072913
§ 371 (c)(1),
(2) Date: Feb. 24, 2021

(87) PCT Pub. No.: WO2020/043755
PCT Pub. Date: Mar. 5, 2020

(65) Prior Publication Data

US 2021/0178215 A1 Jun. 17, 2021

(30) Foreign Application Priority Data

Aug. 28, 2018 (CH) ..... CH01036/18

(51) Int. Cl.
*A63B 21/16* (2006.01)
*A63B 21/00* (2006.01)
*A63B 21/008* (2006.01)

(52) U.S. Cl.
CPC ..... *A63B 21/169* (2015.10); *A63B 21/4047* (2015.10); *A63B 21/00072* (2013.01); *A63B 21/0087* (2013.01); *A63B 2210/50* (2013.01)

(58) Field of Classification Search
CPC ..... A63B 21/00058; A63B 21/00065; A63B 21/00069; A63B 21/00072;
(Continued)

(56) References Cited

U.S. PATENT DOCUMENTS 4,275,882 A * 6/1981 Grosser ..... A63B 21/4035 482/112
4,512,570 A * 4/1985 Tardivel ..... A63B 7/04 482/37

(Continued)

FOREIGN PATENT DOCUMENTS

DE 484881 C 10/1929
DE 29914879 U1 12/1999

(Continued)

OTHER PUBLICATIONS

International Search Report in PCT/EP2019/072913 dated Dec. 6, 2019, 5 pages.

(Continued)

*Primary Examiner* — Loan B Jimenez
*Assistant Examiner* — Zachary T Moore
(74) *Attorney, Agent, or Firm* — Pearne & Gordon LLP

(57) ABSTRACT

An exercising device including a lever or power arm which is able to be arranged by a first end on a retaining element at a first articulated joint in a way pivotable about a pivot axis or pin, whereby a resistance element is able to be coupled by a first end region at a first coupling point on the power arm, and by a second end region at a second coupling point at a second articulated joint on the retaining element. The exercising device is able to be detachably arranged on a structure by means of an engaging connection, which is formed by a hook-shaped recess and a rod-shaped element and whereby the exercising device is lockable in an engaged position by means of a fixation.

14 Claims, 5 Drawing Sheets

(58) Field of Classification Search
CPC ..... A63B 21/00189; A63B 21/0083; A63B 21/0085; A63B 21/0087; A63B 21/022; A63B 21/023; A63B 21/025; A63B 21/026; A63B 21/027; A63B 21/028; A63B 21/04; A63B 21/0407; A63B 21/0442; A63B 21/045; A63B 21/0455; A63B 21/05; A63B 21/055; A63B 21/0552; A63B 21/0557; A63B 21/159; A63B 21/1618; A63B 21/169; A63B 21/4023; A63B 21/4033; A63B 21/4035; A63B 21/4041; A63B 21/4047
See application file for complete search history.

(56) References Cited

U.S. PATENT DOCUMENTS 4,618,140 A * 10/1986 Brown ..... A63B 21/169 482/73
4,982,957 A * 1/1991 Shields ..... A63B 21/0728 482/107
5,330,406 A * 7/1994 Patterson ..... A63B 21/4047 482/113
5,487,714 A * 1/1996 Ferrari ..... A63B 21/154 482/121
5,918,837 A * 7/1999 Vicain ..... H02G 3/26 174/72 A
9,108,079 B2 * 8/2015 Solow ..... A63B 22/0089
10,456,612 B2 * 10/2019 McGhee ..... A63B 1/00
10,646,744 B2 * 5/2020 Steenekamp ..... A63B 1/005
2003/0186792 A1 * 10/2003 Keeler ..... A63B 21/4043 482/121
2007/0155595 A1 * 7/2007 Rogers ..... A63B 21/08 482/97
2007/0155596 A1 * 7/2007 Rogers ..... A63B 21/0615 482/97
2009/0270231 A1 * 10/2009 Hall ..... A63B 23/10 482/79
2016/0263414 A1 9/2016 Swanson
2016/0324717 A1 * 11/2016 Burton ..... A61H 7/001
2018/0236295 A1 * 8/2018 Oltorik ..... A63B 21/4013
2020/0114197 A1 * 4/2020 McGhee ..... A63B 21/4033
2020/0254298 A1 * 8/2020 Innocenzi ..... A63B 23/1209

FOREIGN PATENT DOCUMENTS

DE 202010003344 U1 6/2010
EP 0146274 A1 6/1985
WO 2014146710 A1 9/2014

OTHER PUBLICATIONS

Written Opinion in PCT/EP2019/072913 dated Dec. 6, 2019, 5 pages.

* cited by examiner

MOBILE TRAINING DEVICE

TECHNICAL FIELD OF THE INVENTION

The present invention relates to a mobile exercising device, in particular a mobile exercising device for exercising the muscles.

STATE OF THE ART

Exercising devices for exercising specific groups of muscles or muscles in general are available to users in fitness centers, in gymnasiums, in medical settings as well as also in the private sphere. As a rule, such apparatuses comprise a supporting frame installed in a fixed way on which a more or less convertible exercising device is disposed so that the user is provided with diverse application possibilities for exercising.

Known from EP 0 146 274 is an exercising apparatus, which comprises a supporting structure which is mountable in a fixed way on a wall and is designed as a track on which an exercising unit is received in a slidable and detachable way. The exercising unit comprises for this purpose a correspondingly designed retaining element. The exercising unit further comprises a lever, which is coupled to the retaining element in a way pivotable about a horizontally disposed pivot pin. The vertical movement of the lever takes place against a resistance force from a resistance element pivotably disposed on the retaining element, whereby one end of the resistance element is connectible to the lever by means of an adjustable fixing device. Shown to be disadvantageous thereby is that the connection of the exercising device to the supporting frame is complex.

In particular for the private sphere, but absolutely also in a public setting, there is indeed a demand for mobile, transportable and stowable, flexibly customizable and adjustable exercising devices with which a comprehensive exercising of the human body is possible.

SUMMARY OF INVENTION

The present invention therefore has as an object to develop an exercising device that is universally usable as mobile exercising device, i.e. which can be attached to different structures simply and without specific auxiliary means, whereby these structures do not have to be specially designed just for the exercising device.

This object is achieved with an exercising device according to the invention as set forth in the independent claim 1. Advantageous embodiments are described in the dependent claims and in the description.

The exercising device according to the invention comprises a lever or power arm, which is able to be arranged by a first end on a retaining element at a first articulated joint in a way pivotable about a pivot axis or pin, whereby a resistance element is able to be coupled by a first end at a first coupling point on the lever or power arm, and by a second end at a second coupling point on the retaining element. According to the invention, the exercising device is able to be detachably arranged on a structure by means of an engaging connection, whereby the engaging connection is formed by a hook-shaped recess and a rod-shaped element and whereby the exercising device is lockable in an engaged position by means of a securing means. In the context of this application the term "hook-shaped recess" is not to be understood exclusively in a literal sense. In particular this term encompasses all devices which can enter into a firm engaging connection with a corresponding rod-shaped element.

In one embodiment, the hook-shaped recess is provided on the retaining element and the rod-shaped element on the structure. The hook-shaped recess thereby provides a locking seat for the engaging connection, whereby the locking seat is absolutely able to be also designed as an independent hook element connectible to the retaining element.

Alternatively, the hook-shaped recess can be provided on the structure and the rod-shaped element on the retaining element, which are designed in a way coordinated with one another such that they enter into an engaging connection and a fixation.

The exercising device according to the invention is thus able to be detachably arranged and fixed on a structure without auxiliary means. The hook-shaped recess designed as engaging element is designed in a way complementary to the rod-shaped element and can be brought into detachable engagement with the latter. The exercising device according to the invention engaged and fixed on the structure makes possible for a user an exercising through movement of the lever or power arm by pressing, pushing and pulling in vertical and/or horizontal direction, so that virtually every group of muscles of a human body is able to be exercised and/or treated. Through the design of the retaining element, for example as a bow or bracket, in which at a first end the first coupling point for the lever or power arm and at the second end the resistance element is coupled in a hinged way, an optimal introduction of force results.

Preferably the retaining element comprises two side parts disposed parallel to one another and connected together, between which, at one end, the joint axis of the first articulated joint is disposed for pivotable receiving of the power arm and at another end the joint axis of the second articulated joint is disposed for pivotable receiving of the resistance element.

The retaining element can however also comprise a first and a second subcomponent, which are connected to one another, and whereby in the one the power arm is received and in the other the resistance element is received.

Furthermore it can be foreseen that the power arm is designed in such a way that it is pivotable about a joint axis, which can be designed as rod-shaped element of the structure and whereby the rod-shaped element is at least partially surrounded by the hook-shaped recess or respectively the hook element, designed on the power arm. Something comparable can be foreseen also with respect to the resistance element. The resistance element is thereby disposed in a way pivotable about a rod-shaped element of the structure. The coupling point is designed in such a way that the rod-shaped element is at least partially surrounded by an elastic clamping means.

The resistance element can be designed as spring element, e.g. as pneumatic cylinder, so that further adjustment possibilities result. In particular, by means of a compressed air line to a compressed air reservoir, the pressure can be changed and thus the amount of force to be applied set practically as desired. The spring element is preferably designed as compression spring element.

The first coupling point for the resistance element on the power arm can be designed in an adjustable way so that the spacing of the first coupling point to the first articulated joint is adjustable. The force effect on the power arm can thereby be changed. Accordingly also the characteristic of the force is changed via the movement path of the power arm, whereby, in combination with the force increase in the resistance element, both degressive, constant or progressive force curves can be achieved. For this purpose the one end region of the resistance element can have a first articular surface with a first curvature. Provided along the power arm can be an adjustment area comprising a series of second articular surfaces, which each have a second curvature that is designed to be complementary to the first curvature of the resistance element. Accordingly the one end region of the resistance element with the first articular surface is able to be brought into operative connection with one of the second articular surfaces, formed on the power arm. Furthermore the power arm is able to be pressed via a further spring element against the one end region of the resistance element, in such a way that the two articular surfaces in operative connection are kept in contact. The further spring element can thereby be designed as band or cord which is connectible by one end to the power arm and by the other end to the retaining element.

The power arm can be equipped at one end region with an extension part and/or diverse actuation elements, so that the possibilities for exercises can be expanded. Corresponding actuation elements can be a rod, a grip, loops, etc. Thus the power arm can be provided with an extension part, on which the actuation elements are able to be installed and which is able to be pushed into the power arm telescopically and is able to be pulled out of the latter and is lockable in the corresponding position. Achieved thereby is that the resistance force can be changed and can be adapted to the needs.

The structure, on which the exercising device is able to be disposed and fixed, can basically take any desired form that, for engaging connection, provides the hook-shaped recess or respectively the hook element or the rod-shaped element. Preferred is the structure on a wall, in particular attachable in vertical direction. The structure can be, for example, known gymnastic wall bars with rungs or respectively bars disposed between flanges or respectively side elements, which rods or bars are designed as rod-shaped elements.

In one embodiment, the structure fixable to a wall has side elements, between which horizontal rods disposed parallel to one another are received, which rods each extend in horizontal direction beyond the side elements. The thus designed structure can also be considered to be a type of gymnastic wall bars. Via the laterally protruding rods or respectively rod-shaped elements possibilities result for using the structure not only for attaching an exercising device according to the invention but also for attaching further elements for exercising purposes, for example an elastic band or Theraband.

Alternatively the structure can have side elements connected to one another in which accommodations are formed. The accommodations can be designed as hook-shaped recesses in which, for example, a rod or respectively a rod-shaped element, provided on the retaining element, is insertable and lockable therein.

The exercising device, which is connectible to the structure, has engaging elements, in order to detachably fix it on the structure. The design of the engaging element is coordinated with the design of the structure. Thus on the retaining element of the exercising device, on a back side, a hook-shaped recess and/or a hook element can be formed as locking seat, comprising an at least partially enclosed curved hollow space. In particular formed on the side parts of the retaining elements is in each case a hook-shaped recess as locking seat, which can be brought into engagement with a rod-shaped element as engaging element of the structure, so that a detachable engaging connection is formed.

Alternatively a hook element on the retaining element can be connectible as locking seat of the engaging connection for arrangement of the exercising device on the structure. The engaging element of the engaging connection can be designed on the structure as rod-shaped element or respectively as a bar, a rod or in another form, for example as a bar or respectively rungs of gymnastic wall bars.

In a simple, universally usable embodiment of the exercising device according to the invention, this exercising device is hung on wall bars at a suitable height by means of the hook-shaped recess or respectively hook element. Hook element and rungs form a detachable engaging connection for fixing the exercising device at any desired height and in at least two orientations which allow a user to move the power arm of the exercising device in vertical direction against the resistance of the resistance element. Furthermore, after ending the exercise, the exercising device can be simply lifted from the structure and transported. The elements of the exercising device, connected together, such as resistance element, power arm, retaining element can thereby be at least partially released from their connections in such a manner that the exercising device is foldable or collapsible into a small format.

Gymnastic wall bars, a structure, as well as also a structure with a plurality of locking seats, which is fixed to a wall with vertical orientation, offer the possibility to fix the exercising device simply and at individual height.

Once again expanded possibilities result when the structure is fixable in any desired orientation on a wall or floor or the like and/or is also designed in such a manner that its orientation is individually adjustable and fixable.

It is also possible for an adapter or respectively interim piece to be able to be additionally disposed between a structure, fixed in vertical or other orientation, and the exercising device, by means of which adapter or interim piece the orientation of the arranged exercising device is changeable. Thus, for example, by means of the hook-shaped recess or respectively the hook element, the exercising device can be engaged to an interim piece disposed on the structure and connected thereto. Depending upon orientation and length of the interim piece, which, on the one hand is disposed on the structure, and, on the other hand, provides at least one rod-shaped element for engagement with the exercising device, the power arm of the exercising device can be brought into a position inclined with respect to the horizontal. If the interim piece is designed in such a way that its length is adjustable, for example it can be changed in length telescopically, the power arm can be oriented at virtually any angle with respect to the horizontal.

It is foreseen, according to the invention, that the exercising device, which forms an engaging connection with the structure, is lockable thereto by means of an additional fixation.

In one embodiment it is foreseen that the fixing takes place by means of an elastic elongated element, preferably a band or cord. The elastic elongated element is connected firmly by one end to the exercising device, whereby a second end of the same is also connected firmly or detachably to the exercising device. In one embodiment a detachable connection of one of the ends of the elastic elongated element includes a clamping device provided on the retaining element of the exercising device, for example designed with an accommodation or seat in which the elastic elongated element is clamped and is fixable by means of an end piece. The elastic elongated element connected in such a way to the exercising device forms between its two ends a sling or respectively loop which is connectible to the structure. The length of the elastic elongated element is universally adjustable and its fixing in the clamping device is easy to release.

Thus if the structure has laterally protruding rod-shaped elements, the sling or respectively loop formed by the elastic elongated element can be stretched or respectively pulled over these, without the elastic elongated element having to be released from its attachments. Hence the exercising device, by means of the hook-shaped recess or respectively the hook element, is hooked on a rod-shaped element of the structure or respectively engaged therewith and is fixed on another of these spaced-apart rod-shaped elements of the structure by means of the sling of the elastic elongated element. Preferably correspondingly fixed elastic elongated elements are provided on both side parts of the retaining element, so that a fixing of the exercising device symmetrically on the structure on both sides is achieved.

In an embodiment in which the structure is conventional gymnastic wall bars, at least one end of the elastic elongated element is detachably connectible to the exercising device. For fixing the exercising device hooked in the structure, the elastic elongated element, loose at one end, is led around a rung of the structure and is fixed to the retaining element in the clamping device provided thereon, for example in a tensioned state.

In an embodiment, the elastic elongated element can be attached by one end to the power arm of the exercising device and be led through a through hole on the retaining element, in order to be then looped around a first element of the structure and at the other end fixed in a detachable way to the retaining element. Accordingly in this embodiment the spring element for maintaining the connection between articular surfaces of resistance element and power arm and the elastic elongated element are designed as one element. Alternatively, however, the spring element or respectively elastic elongated elements, designed in each case as band or cord, can also be separate elements.

In a further embodiment, an elastic clamping means is provided on the retaining element, for fixing the exercising device, hooked on the structure. The elastic clamping means is designed, for example, as open elastic clasp, in which one of the rod-shaped elements of the structure is receivable in a clamped way or respectively forms a snap connection therewith. The elastic clamping means can also be referred to as fastening clip. Alternatively the elastic clamping means can be designed as an elastic leaf spring, which, correspondingly shaped, forms a stable clamping connection with one of the rod-shaped elements of the structure.

According to the invention, the exercising device can be attached to any available structure. Exercising device and structure form components, coordinated with one another, of an exercising unit.

With the exercising device according to the invention in combination with the structure, an exercising possibility is available which can be arranged and locked in a simple way without auxiliary means. At least two different orientations of the exercising device are thereby possible, and, to be precise, such that the power arm can be pressed either "from above downwards" or "from below upwards" against the resistance element, so that the exercising possibilities are multiplied. As already mentioned, however, any desired orientations of the exercising device can also be made available, for example by means of a corresponding arrangement of the structure and/or by means of corresponding interim pieces, receivable between structure and exercising device. As a result of the mobility, the exercising device, or respectively the exercising unit comprising exercising device and structure, can be well stowed and transported so that its possibilities for use are also expanded.

In particular, components of the exercising device can be made of a lightweight material, preferably wood. An exercising device of this kind is very light, so that mobility is accordingly provided. Of course individual components of the exercising device can however also be made of a different material, for example metal.

BRIEF DESCRIPTION OF THE DRAWINGS

Further preferred features and preferred embodiments will be explained in the following with reference to embodiment examples and the figures.

DETAILED DESCRIPTION OF EMBODIMENTS OF THE INVENTION

Figure 1:
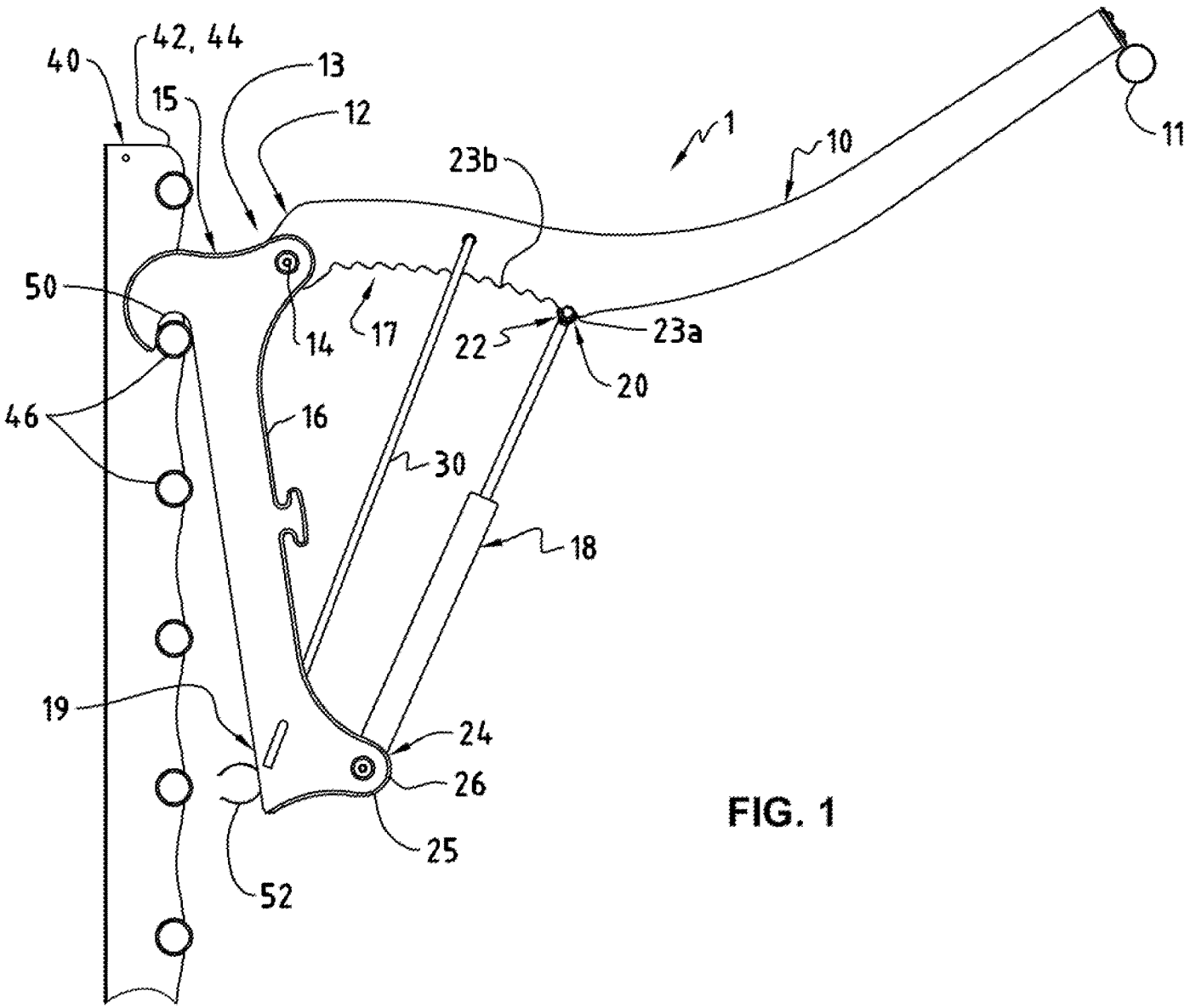
FIG. 1 shows a schematic side view of an exercising device and a structure according to a first embodiment of the invention.

FIG. 1 shows in a side view the exercising device 1 according to the invention in combination with a structure 40 according to a first embodiment. This exercising device 1 comprises a power arm 10. This power arm 10 can be equipped on a free end region with an actuation element 11, for example, via which the power arm 10 can be actuated by an exercising person. At another end, the first end 12, the power arm 10 is provided at a first coupling point with a first articulated joint 13, via which the power arm 10 is connected to a retaining element 16 in an articulated way. In particular the power arm 10 is pivotable with respect to the retaining element 16 about a pivot axis or pin 14 on the first articulated joint 13.

The retaining element 16 can be designed as bow or bracket, whereby at a first end 15 of the retaining element 16 the first articulated joint 13 is disposed for connection of the power arm 10. The power arm 10 is furthermore connected by means of a resistance element 18 to the retaining element 16. At a second coupling point 22 a first end region 20 of the resistance element 18 is coupled to the power arm 10. This second coupling point 22 and thus the first end region 20 of the resistance element 18 is adjustable along an adjustment area 17 on the power arm 10. The resistance adjustment can also be solved in an infinitely variable or stepless way however, whereby the resistance element can be locked along the power arm at any desired place. A second end region 24 of the resistance element 18 is coupled at a second coupling point 26 to the retaining element 16 or respectively connected therewith in a pivotable way by means of a second articulated joint 25. In the embodiment example shown here, the resistance element 18 is designed as pneumatic spring; other spring elements would be also conceivable however.

The retaining element 16 could however consist in principle of a plurality of parts. Thus it is absolutely possible for the first articulated joint 13 for connection of the power arm 10 to be disposed on a first subcomponent, which is separate from a second subcomponent, in which the resistance element 18 is connected in a way pivotable therewith, by means of a second articulated joint 25.

The first end region 20 of the resistance element 18 comprises a first articular surface 23*a* with a curvature, which is designed in a complementary way to the second articular surfaces 23*b*, each with a second curvature, provided on the power arm 10 by way of the adjustment area 17. Hence the first articular surface 23*a* on the first end region 20 of the resistance element 18 thereby comes into operative connection with one of the second articular surfaces 23*b* on the adjustment area 17 on the power arm 10, whereby the first articular surface 23*a* and the second articular surface 23*b* is pressed via a further spring element 30 against the first end region 20 of the resistance element 18, so that the two in operative connection—first articular surface 23*a* and second articular surface 23*b*—are kept in contact with one another. The further spring element 30 can be designed in particular as a band or cord which is able to be arranged and fixed between power arm 10 and retaining element 16 in a tensioned way.

The exercising device 1 is designed to be detachably disposed and locked into position on the structure 40 fixable to a wall. For this purpose, according to the embodiment shown in FIG. 1, the structure 40 is designed as a kind of wall bars. The structure 40 has two side elements 42, 44, in which a multiplicity of rod-shaped elements 46, disposed parallel to one another, also referred to as bars or rods, are received, which protrude laterally in horizontal direction beyond the side elements 42, 44. The multiplicity of the rod-shaped elements 46 are disposed along the side elements 42, 44 at predetermined regular or irregular intervals. The rod-shaped elements 46 have, for example, a round cross-sectional shape, but could also have another suitable cross-sectional shape.

In order to fix the exercising device 1 to the structure 40 in a detachable way, a hook-shaped recess 50 is formed, or a hook element 50 is provided, on the exercising device 1 or respectively on the included retaining element 16 at a first end 15 in such a way to be able to be brought in engagement with one of the rod-shaped elements 46 of the structure 40. The hook-shaped recess 50 or respectively the hook element 50 is thereby oriented against the extension of the power arm 10, i.e. on a rear side of the retaining elements 16. By means of the coordination of the shapes of the hook-shaped recess 50 or respectively the hook element 50 and the rod-shaped element 46 an engaging connection is formed, so that the exercising device 1 is kept locked on the structure 40.

For fixing the exercising device 1, an elastic clamping means 52 is provided thereon at a second end 19 of the retaining element 16, which means are designed to form a snap connection with one of the rod-shaped elements 46. The elastic clamping means 52 is designed as open clasp or fastening clip in such a way that one of the rod-shaped elements 46 is able to be pressed through an opening and in engaged state this element is held in a clamped way. The elastic clamping means 52 can however also consist of a single spring leaf which is shaped and positioned in such a way that it is able to enter into a stable clamping connection, owing to its elasticity, with one of the rod-shaped elements 46.

Figure 2:
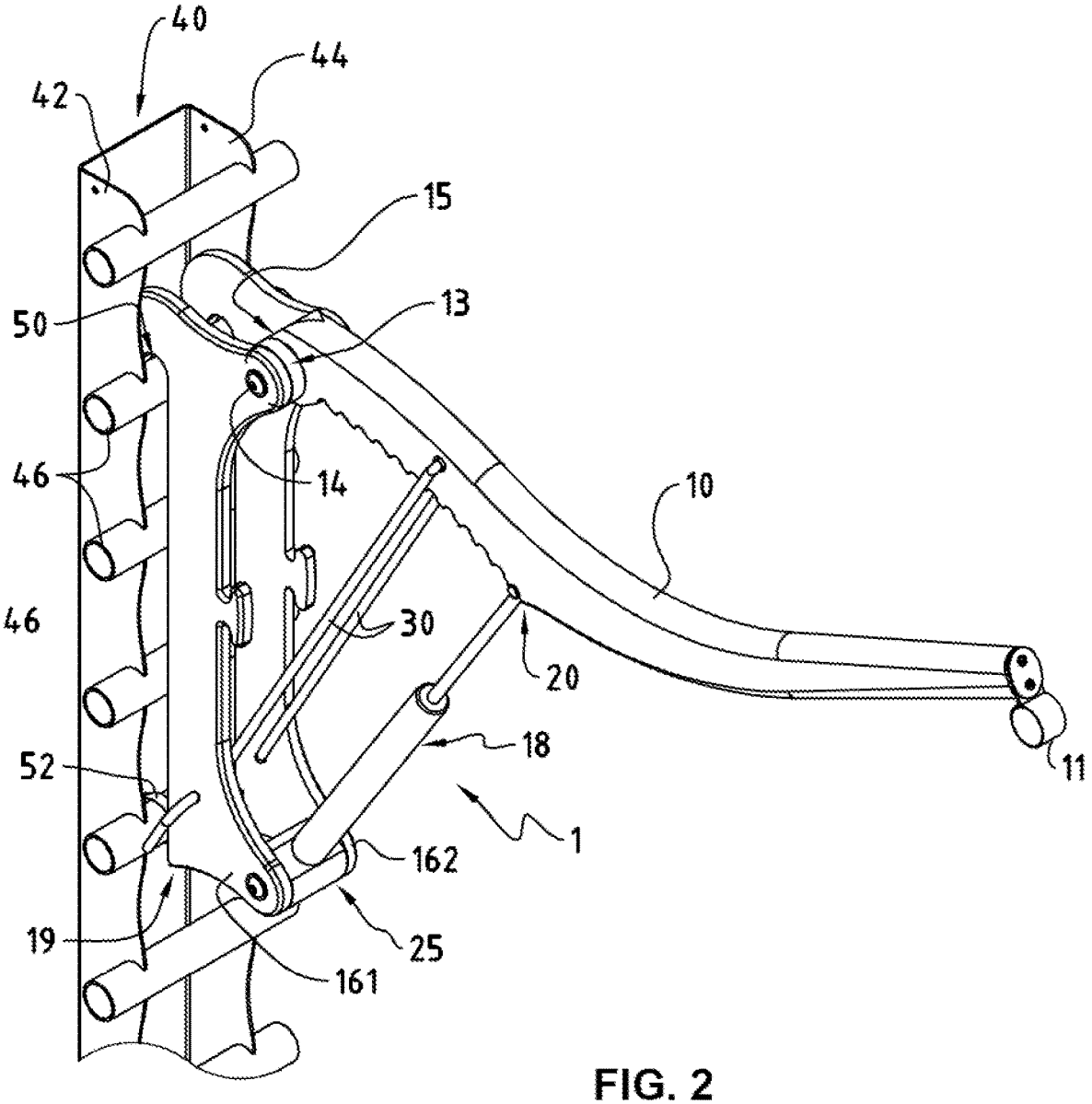
FIG. 2 shows a schematic perspective view of the exercising device and the structure according to the first embodiment of the invention in engaged and fixed connection.

FIG. 2 shows a perspective view of the first embodiment of the exercising device 1 according to the invention, fixed to the structure 40. In the perspective view of FIG. 2, it can be seen that the structure 40 comprises the side elements 42, 44, between which the rod-shaped elements 46 extend and laterally protrude beyond them. Further exercising devices can thereby be attached on this structure 40, for example there is space for an elastic band or Theraband, which is attachable at any desired height on one of the rod-shaped elements 46.

It follows furthermore from FIG. 2 that the retaining element 16 comprises two side parts 161, 162 disposed parallel to one another, which are connected together by means of pivot pin 14 of the first articulated joint 13 and the pivot pin of the second articulated joint 25 at the first end 15 or respectively the second end 19. In each case at the first end 15 the side parts 161, 162 have a hook-shaped recess 50, with an opening having an orientation opposite that of the power arm 10. Alternatively, however, at the first end 15 on the retaining element 16 a hook element 59 can also be disposed in a suitable way, which hook element can be brought into engagement with one of the rod-shaped elements 46 of the structure 40. Disposed on the second end 19 of the retaining elements 16 of the exercising device 1 is the elastic clamping means 52. This elastic clamping means 52 designed as open fastening clip can be engaged on one of the rod-shaped elements 46 in a simple way by slight pressure and provides a secure attachment for the rod-shaped element 46 after the point of constriction. Furthermore it follows from the depiction in FIG. 2 that the spring element or elements 30 are disposed, on the one hand, on the power arm 10, and, on the other hand, on the retaining element 16, which spring elements keep the first end region 20 of the resistance element 18 in engagement with the power arm 10. In particular the spring elements 30 can be designed as bands or cords, which are fixed to the corresponding components.

Figure 3:
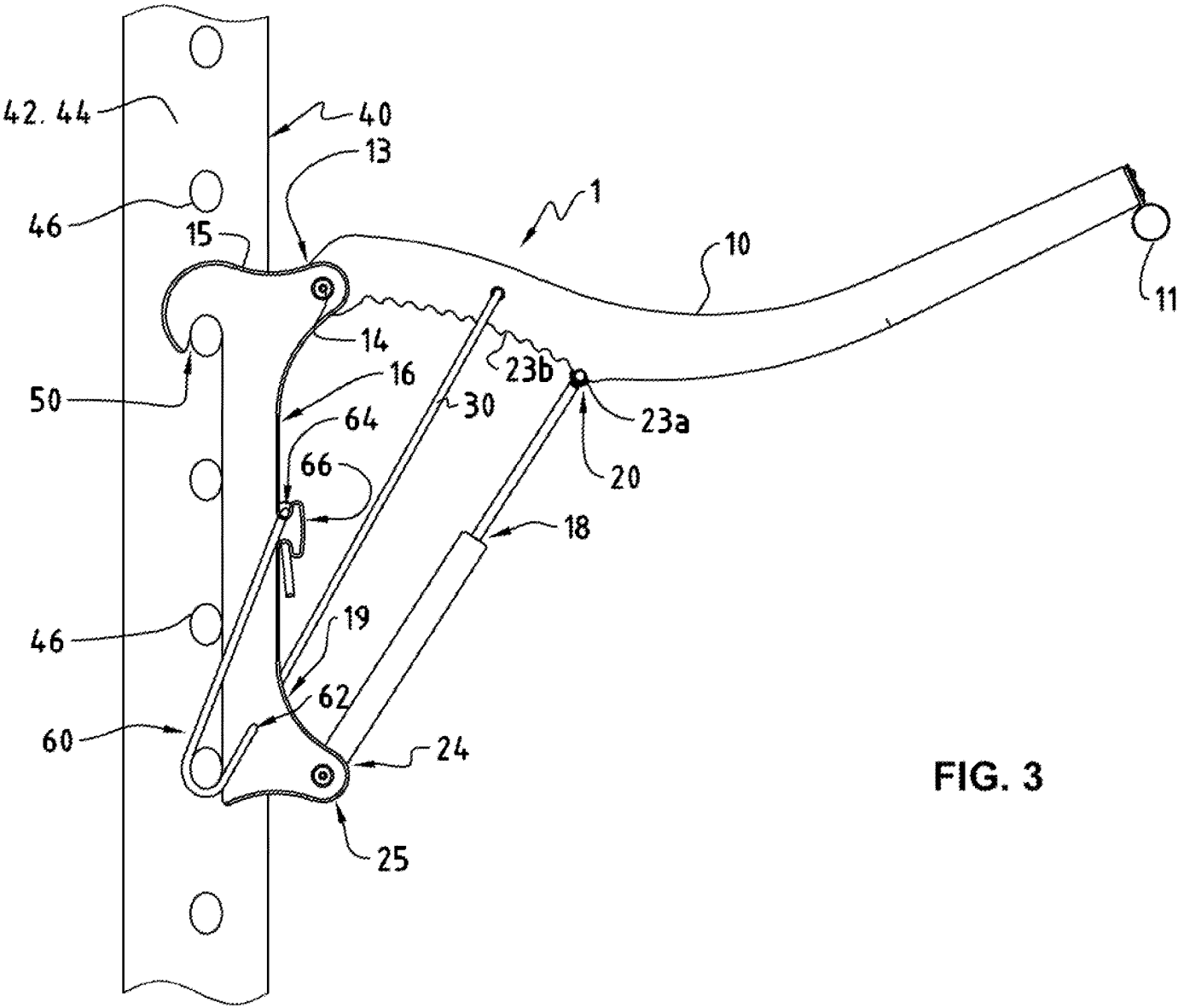
FIG. 3 shows a schematic side view of an exercising device and a structure according to a second embodiment.

FIG. 3 shows an exercising device 1 according to the invention in combination with the structure 40, according to a second embodiment. As already in the first embodiment shown in FIGS. 1 and 2, the exercising device 1 comprises the power arm 10, arranged at the first articulated joint 13 in a way pivotable about the pivot axis or pin 14, the retaining element 16 and the resistance element 18, in engagement between power arm 10 and retaining element 16 in a way pivotable at the second articulated joint 25 with the second end region 24, or respectively in engagement by means of the first articular surface 23*a* on the first end region 20 with the second articular surface 23*b*. Furthermore the spring element or elements 30 is or are stretched in a tensioned way between power arm 10 and retaining element 16. The structure 40 shown in FIG. 3 is designed in the form of wall bars known per se, comprising, between side elements 42, 44, rod-shaped elements 46, which however—in contrast to the embodiment shown in FIGS. 1 and 2—do not protrude horizontally to the side. The exercising device 1 is hooked or respectively locked on one of the rod-shaped elements 46 by means of the hook-shaped recess 50 formed thereon. Provided for fixing the exercising device 1 in the engaged position is an elastic elongated element 60, for example a cord. In the embodiment shown, one end 62 of the elastic elongated element 60 is fixed at the second end 19 of the retaining element 16. For fixation, the elastic elongated element 60 can be led through a through hole on the retaining element 16 and can be locked in position by means of a mounting piece or a knot. Another end 64 of the elastic elongated element 60 is detachably fixed to a clamping device 66, provided on the retaining element 16. For example, the elastic elongated element 60 can be received in a clamped way in an accommodation provided on the clamping device 66, and be held in position by means of a mounting piece. This detachable attachment of at least one of the ends of the elastic elongated element 60 makes it possible, in a simple way, for fixing of the engaged exercising device 1, for the elastic elongated element to be led around one of the rod-shaped elements 46 and to be fixed in a more or less tensioned state to the clamping device 66.

Figure 4:
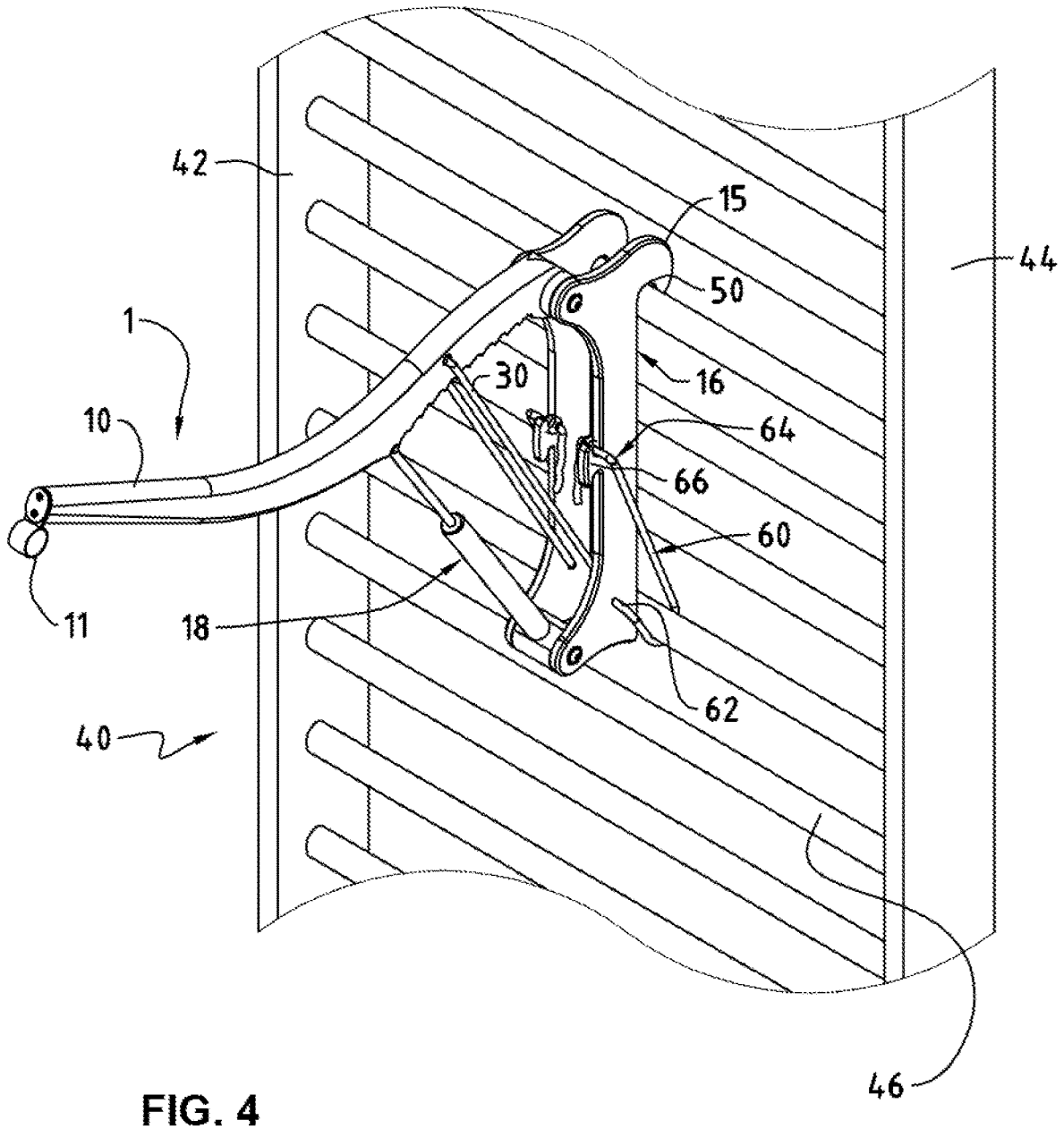
FIG. 4 shows a schematic perspective view of the exercising device and the structure according to the second embodiment.
Figure 5:
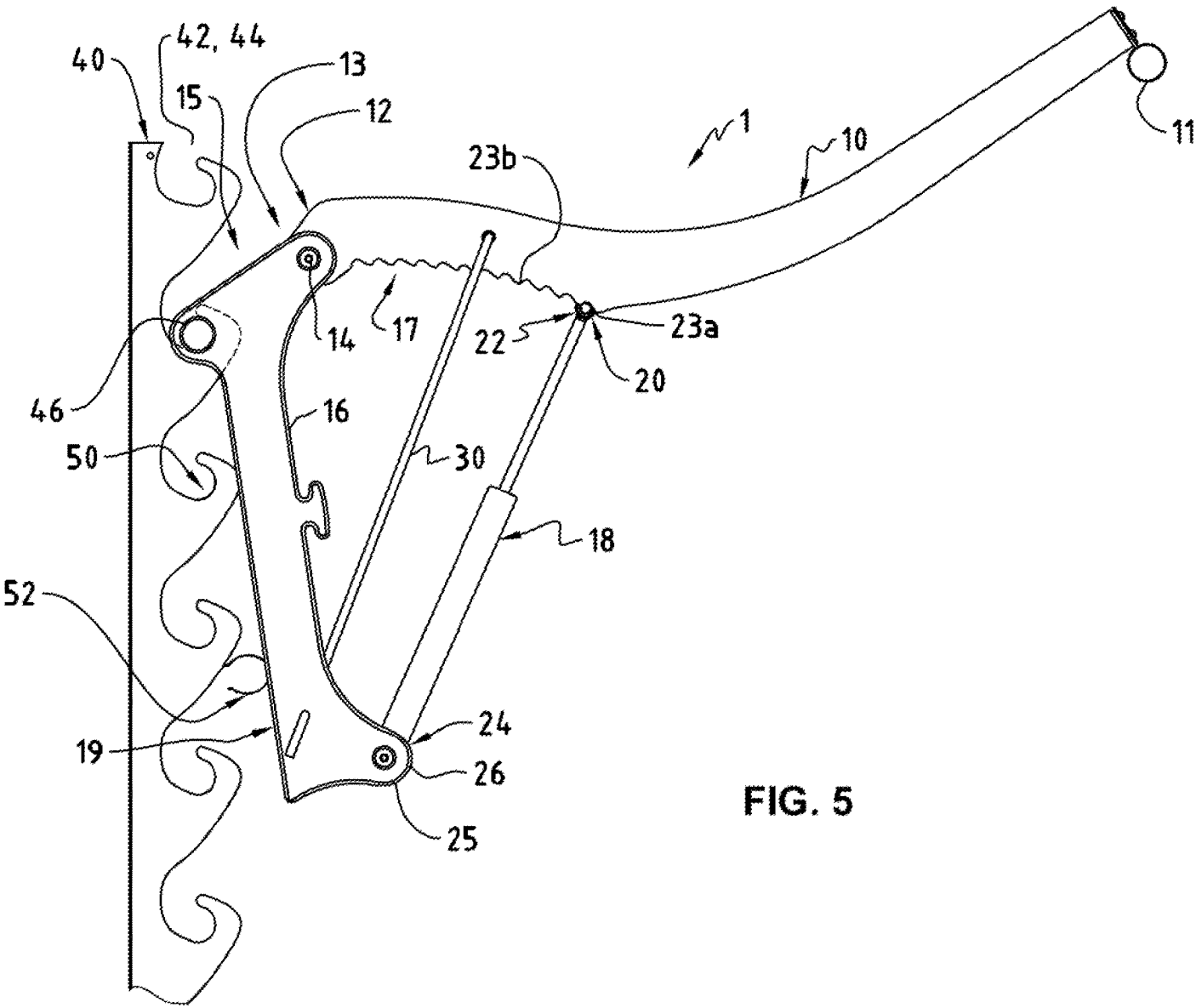
FIG. 5 shows a schematic side view of an alternative exercising device and a structure.

FIG. 4 shows a perspective view of the second embodiment according to FIG. 3. As in the case of commonly known gymnastic wall bars, the structure 40 comprises rungs, bars or respectively rod-shaped elements 46, disposed between side elements 42, 44. The exercising device 1 is hooked and locked on one of the rod-shaped elements 46 by means of the hook-shaped recess 50 provided on the first end 15. For fixing, the elastic elongated element 60, with its end 62 firmly connected to the retaining element 16, is wrapped around one of the rod-shaped elements 46 and is fixed at the second end 64 by means of the provided clamping device 66 in a more or less tensioned state. Preferably, elastic elongated elements 60 are provided on both sides of the retaining element 16.

In a preferred embodiment, the elastic elongated element 60 and the spring element 30 can be formed by a continuous cord or band, which is firmly connected to the power arm 10 at one end and is led through a through hole on the retaining element 16, in order to be then led around one of the rod-shaped elements 46 and fixed in a detachable way to the clamping device 66. The resistance element 18 is thus kept in contact with the power arm 10.

At this point it is to be noted that for fixation of the exercising device 1 according to the invention, besides the already mentioned elastic clamping means 52 and the elastic elongated element 60 also other fixing elements or respectively fixing devices can be used. For example, a magnetic fixation is conceivable in which an element adjacent to the exercising device 1 and another adjacent to the structure 40 are able to be connected together through magnetic force. This can involve in particular suitable permanent magnets, whose shape and size or magnitude can be selected in such a way that an optimal fixation of the exercising device 1 to the structure 40 can be ensured. Besides magnetic fixation, other mechanical fixing elements are also conceivable, e.g. screws and corresponding nuts or rotatable hook elements, which can be turned in order to fix securely the exercising device 1 to the structure 40.

The invention claimed is:

1. An exercising device, comprising:

a power arm configured to be arranged by a first end on a bracket at a first articulated joint in a way pivotable about a pivot axis or pin; and a resistance element configured to be coupled by a first end region at a first coupling point on the power arm and by a second end region at a second coupling point at a second articulated joint on the bracket;

wherein the exercising device is configured to be detachably arranged on a structure by means of an engaging connection formed by a hook-shaped recess on one of the structure and the bracket and a rod-shaped element on the other of the structure and the bracket, the exercising device being lockable in an engaged position by means of an elastic clamp, wherein the elastic clamp engages with a further rod-shaped element formed on the structure.

2. The exercising device according to claim 1, wherein the hook-shaped recess is provided on the bracket and the rod-shaped element is provided on the structure.

3. The exercising device according to claim 1, wherein the hook-shaped recess is a hook element connectible to the bracket.

4. The exercising device according to claim 1, said rod shaped element being a first rod shaped element, wherein the structure comprises side elements, and said first rod-shaped element and a second rod-shaped element both received therein, which protrude laterally beyond the side elements.

5. The exercising device according to claim 1, wherein the hook-shaped recess is provided on the structure and the rod-shaped element on the bracket.

6. The exercising device according to claim 1, wherein the power arm is configured to be equipped at a second end with an extension part and/or actuation elements.

7. The exercising device according to claim 1, adapted to exercise muscles of a human body.

8. The exercising device according to claim 1, wherein the structure is attachable to a wall.

9. Exercising device according to claim 1, wherein said exercising device is a modular exercising unit, which is adapted to be taken apart.

10. An exercising device, comprising:

a power arm configured to be arranged by a first end on a bracket at a first articulated joint in a way pivotable about a pivot axis or pin;

a resistance element configured to be coupled by a first end region at a first coupling point on the power arm and by a second end region at a second coupling point at a second articulated joint on the bracket, wherein the exercising device is configured to be detachably arranged on a rod-shaped element of a structure by a hook-shaped recess of the bracket; and an elastic elongated element configured to be arranged on the bracket and adapted to be led around the rod-shaped element of the structure to lock the exercising device in an engaged position.

11. The exercising device according to claim 10, wherein a first end of the elastic elongated element is fixed to the bracket and a second end of the elastic elongated element is detachably fixable to the bracket.

12. The exercising device according to claim 10, wherein a first end of the elastic elongated element is fixed to the power arm and a second end of the elastic elongated element is detachably fixed to the bracket, and wherein an intermediate portion of the elastic elongated element is led through a hole in the bracket.

13. The exercising device according to claim 12, wherein the elastic elongated element comprises a spring arranged to keep the resistance element at the first coupling point in contact with the power arm.

14. The exercising device according to claim 10, wherein the elastic elongated element is a band or a cord.

* * * * *